United States Patent [19]

Kafka et al.

[11] 4,354,445

[45] Oct. 19, 1982

[54] RETRACTABLE LIFT RING

[75] Inventors: Charles F. Kafka, Bradenton; Robert S. Kafka, Maitland, both of Fla.

[73] Assignee: Meacham Marine Products, Inc., Sarasota, Fla.

[21] Appl. No.: 190,895

[22] Filed: Sep. 25, 1980

[51] Int. Cl.[3] ..... B63B 21/04

[52] U.S. Cl. ..... 114/218

[58] Field of Search ..... 114/230, 218, 343, 377, 114/380; 410/82, 83, 107, 111; 440/106, 108; 9/1.1, 43, 45

[56] References Cited

U.S. PATENT DOCUMENTS

| | | | |
|---|---|---|---|
| 2,870,733 | 1/1959 | Winther | 114/218 |
| 3,559,943 | 2/1971 | Hammond | 410/82 |
| 3,597,808 | 8/1971 | Johnson | 114/218 X |
| 3,724,796 | 4/1973 | Hawkins | 410/83 |
| 3,749,438 | 7/1973 | Loomis | 410/82 X |
| 4,012,157 | 3/1977 | Krause | 403/21 X |
| 4,027,502 | 6/1977 | Stuemky | 403/21 X |
| 4,163,347 | 8/1979 | Marcmann | 403/166 X |
| 4,200,944 | 5/1980 | Gillespie | 114/230 X |
| 4,258,642 | 3/1981 | Burmeister | 440/53 |

FOREIGN PATENT DOCUMENTS

| | | | |
|---|---|---|---|
| 2843267 | 4/1980 | Fed. Rep. of Germany | 410/83 |
| 596309 | 9/1975 | U.S.S.R. | 403/22 |

*Primary Examiner*—Trygve M. Blix
*Assistant Examiner*—Stephen P. Avila
*Attorney, Agent, or Firm*—Julian C. Renfro

[57] ABSTRACT

A lift ring device for installation in the forward portion of the deck of a boat or other item that may need from time to time to be lifted, which device can be retracted when not in use, thus to leave the deck of the boat relatively uncluttered. The lift ring (20, 60) is disposed in a slotted deck plate (12, 52) and out of this slot the lift ring may be readily lifted so that it can serve either as a deck cleat, or in the lifting or towing of the boat. A lower, rod-like portion (26, 66) is integral with the lift ring, and this rod-like portion is slidable in an elongate structural member (16, 56) attached to the underside of the deck plate. We use a compression spring (28, 68) around the rod-like portion in order to insure retraction of the lift ring when not in use, and a sturdy weight bearing device is provided on the lowermost end of the rod-like portion to assure that the lift ring will not separate from the deck plate during the lifting of the boat. The lowermost part of the elongate structural member is provided with a rotatable device (46, 86) to receive the upper, threaded end of a rod attached to the keel of the boat, such that no turnbuckle is required in securing the lift ring device firmly to the keel.

11 Claims, 12 Drawing Figures

FIG. 2
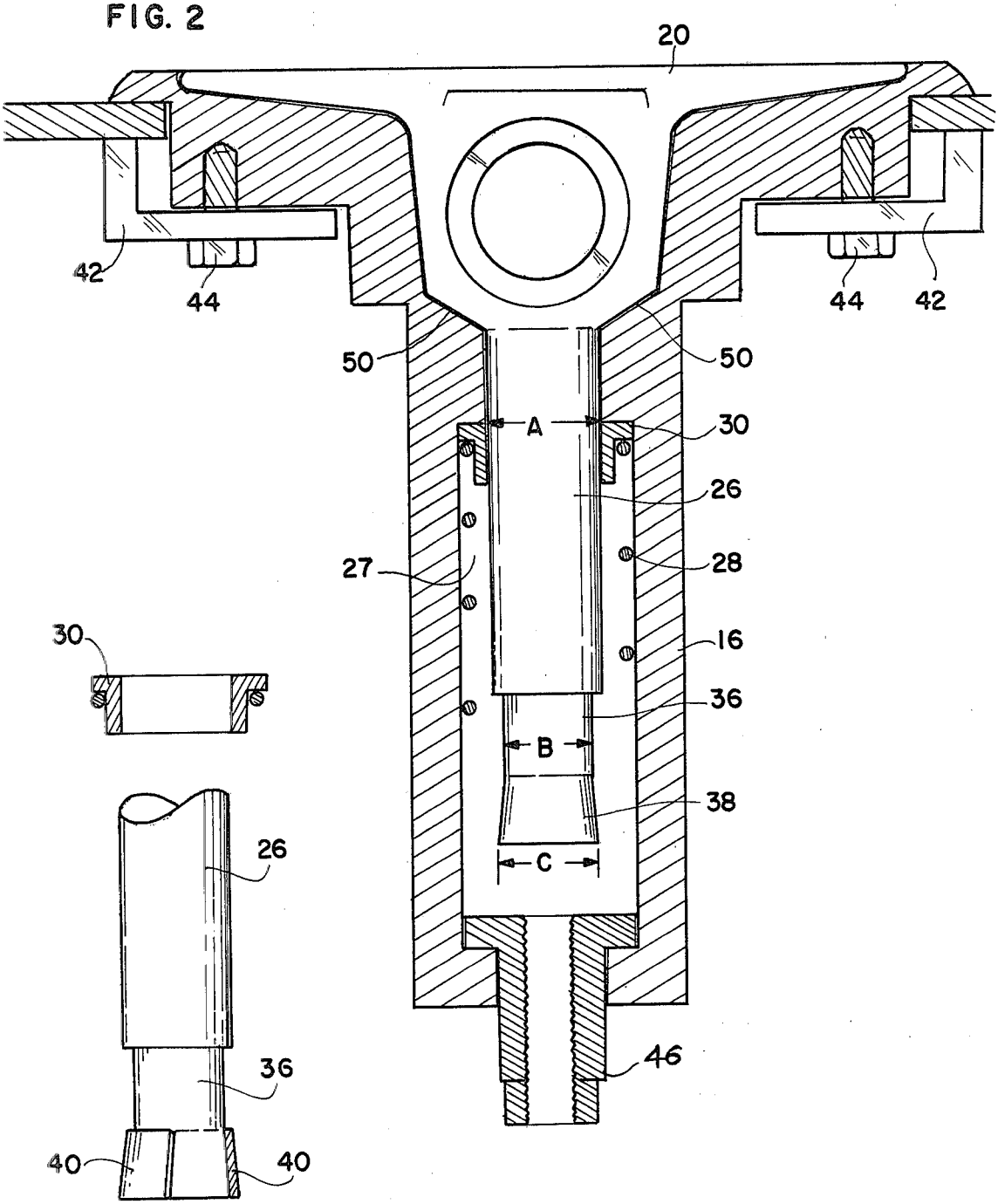
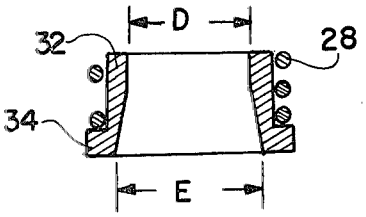
FIG. 2a

RETRACTABLE LIFT RING

TECHNICAL FIELD

The present invention relates to a lift ring device usable in boats and other vessels and vehicles that from time to time are to be lifted upwardly, such as by the use of ropes or cables. Our retractable lift ring normally resides in a slotted base plate, but it can be pulled upwardly for a limited extent to an operative position, such that it can be used in connection with the lifting of the boat or vessel. The lower portion of the lift ring is constituted by a rod-like member, around which is disposed a spring that assures the lift ring returning to its retracted position when not in use. Because the lift ring normally resides in the retracted position, it enables the front deck portion of the boat to remain uncluttered. When in its operative position, the lift ring may be locked so that it can also serve as a cleat on the deck of the boat.

BACKGROUND ART

From time to time it is necessary for boats to be removed from the water, such as in connection with storage on private davits, for storage at marinas, or for repair efforts such as scraping, painting, hull repair, and the like. This operation may be accomplished in several different ways, such as by the use of a marine railway, a submersible dock-like device that can be lifted out of the water by power equipment, a sling arrangement, and by the use of lift rings. This invention is entirely concerned with the latter option.

Although the use of slings has enjoyed considerable popularity in the past, many marinas and boat manufacturers are moving in the direction of the widespread use of lift ring is used at the prow, and a pair of U-bolts used at the stern of the boat. In this way, a marina having the right equipment can lift a boat out of the water with minimum effort, and can place it directly on a wheeled vehicle, on chocks, or in whatever location is preferred.

Inasmuch as a boat may be quite heavy, it is necessary for the lift ring on the front of the vessel to attach directly to the keel, for decks are not designed for upward pulling forces. Since the underside of the prow of a boat often curves for a distance upwardly away from the keel, it is usually necessary for the lift ring to be located substantially aft of the forwardmost portion of the prow, so that it will be disposed to be connected directly to the turn of the keel, or to the forwardmost horizontal portion of the keel.

The prior art lift rings have been of fixed construction, which means that they have presented a substantial obstacle in a forward area which must necessarily be used for tying up bow lines, and which would have been usable as a clear deck space if this obstacle did not exist. The ordinary fixed lift ring protrudes three inches or so above the deck, which presents a substantial hazard over which a passenger or deck hand may trip. It was for the elimination of this type of hazard, for the making available of additional deck space, and for the simplification of lift ring installation that the present invention was designed.

DISCLOSURE OF THE INVENTION

In accordance with this invention we have provided a lift ring of sturdy and economical construction, which quite advantageously is maintained in a flush or retracted position when not in use, thus resulting in an uncluttered prow area of the boat on which it is used. The lift ring is disposed in a slotted housing or base plate mounted in the deck of the boat, with a spring bias normally serving to hold the lift ring in a recessed, non-obstructing position, which spring bias additionally prevents rattling and assists in sealing against entry of water.

When the boat is to be lifted out of the water, the lift ring is grasped by the fingers and pulled up out of its slot in the base plate, directly against the bias of the spring. Then, while maintaining the upward pull, the lift ring is turned 90 degrees to a position in which its base engages certain notches in the base plate. When the ring is then released, it is pulled firmly downwardly by the spring bias, into an operative position in the notches. These notches in the base member prevent undesired rotation of the lift ring back to the position of initial alignment with the base member, thereby preventing an unwanted and sudden retraction of the lift ring.

When the lift ring is residing in the aforementioned notches, it may also serve as a deck cleat, and thus be used advantageously in the tying up of a boat to a dock, or serving as a towing member point at sea. On the other hand, when a line has been passed through or around the lift ring in order that lifting may be accomplished, the lift ring is easily pulled upwardly away from the notches in the base plate, and when in this mode, the lift ring may rotate freely. This latter fact is of advantage in the lifting of the boat, in that twisting of the lift line is unlikely. Subsequent retraction of the lift ring, at the conclusion of the lift, is but an easy matter in that it is merely necessary to lift the ring out of the notches, and align it with its slot. The spring bias accomplishes the retraction.

As in the case of all lift rings, it is normally essential for the lower end of our device to be fastened to the keel of the boat. In accordance with the prior art, it has been customary to utilize a turnbuckle between a pair of sturdy rods so that the connection between the base plate of the lift ring and the keel can be made desirably tight. However, this prior art arrangement had a number of disadvantages, in that turnbuckles were bulky and expensive, rods having normal threads as well as reverse or lefthanded threads were necessary, and quite a bit of time was necessarily consumed for installation in the deck of a boat. In addition, the prior art lift rings were ill adapted to withstand lateral loads, and if for any reason a sideways load was placed on a prior art lift ring, deck damage could ensue inasmuch as the only lateral restraint was a ⅝" rod used to form the keel connection, and four #10 screws used to fasten the deck plate to the deck.

In contrast with the bulky and cumbersome methods of the prior art, we utilize a lift ring arrangement in which a novel lower assembly associated with our base plate completely obviates the need for a turnbuckle. This is made possible by means including the use of a flange nut operatively disposed in the lower assembly, with the flange nut being internally threaded to receive a single rod having normal threads, with the other end of that rod being connected to the keel. As a result of this arrangement, tightening of the connection to the keel is achieved merely by tightening the flange nut, with any turnbuckle type manipulation being entirely obviated.

Inasmuch as the base plate of our lift ring makes substantial contact with the deck, thus dispersing lateral forces over a large area, substantial lateral loads may be successfully withstood without damage.

It is therefore a primary object of this invention to provide a lift ring that is highly satisfactory for its basic purpose or for towing at sea, yet is normally and easily retracted into a flush position on the deck of a boat such that it presents no obstacle over which a person may trip.

It is another object of our invention to provide a lift ring arrangement of sturdy and economical construction, that normally resides in a retracted position in the vicinity of the prow, thus making more of such deck area available for other and highly useful purposes.

It is another object of this invention to provide a retractable lift ring arrangement of attractive appearance, the base plate of which can be easily and satisfactorily connected to the keel of the boat, with installation time being far less than is usual in the case of the lift ring installation, yet with no sacrifice in strength.

It is another object of the invention to provide a lift ring arrangement that is fastened integrally to the deck and keel of a boat, such that a lateral load may be withstood far more satisfactorily than in the case of prior art lift ring arrangements.

These and other objects, features and advantages will become more apparent as the description proceeds.

BRIEF DESCRIPTION OF THE DRAWINGS

FIG. 2 is a view generally along the lines of FIG. 1, but with the lift ring housing cut away so as to show the lift ring in full lines;

FIG. 2*a* is a partially exploded view, revealing details of a first type of spring retaining means on the lowermost portion of the lift ring mechanism;

DETAILED DESCRIPTION

Figure 1:
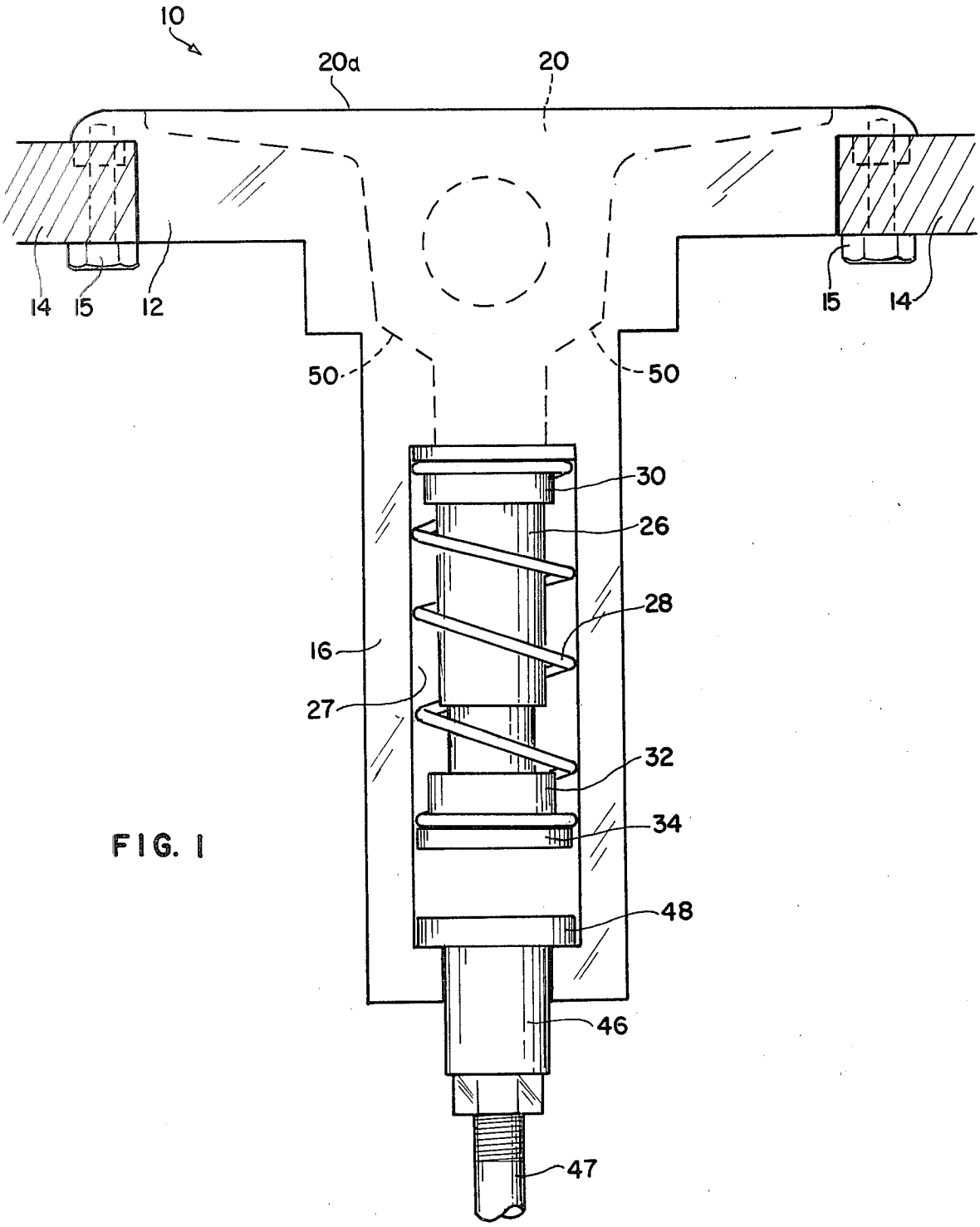
FIG. 1 is a side elevational view of a first embodiment of our invention, showing by dashed lines, our lift ring in a retracted position in its housing.

Turning to FIG. 1, it will there be seen that we have illustrated a first embodiment of a retractable lift ring device 10 in accordance with this invention, which involves the use of a slotted deck plate 12 adapted to be mounted in a suitable aperture in the deck 14 of a boat or other such vessel. Bolts 15 inserted from the underside of the deck may be used to secure the deck plate 12 in the proper position.

An elongate structural member 16 is affixed on the underside of the deck plate 12, and in this instance, we have constructed the members 12 and 16 of one piece of material such as of aluminum or stainless steel. However, the members 12 and 16 could be separate interfitting components, and secured together by machine screws.

Figure 3:
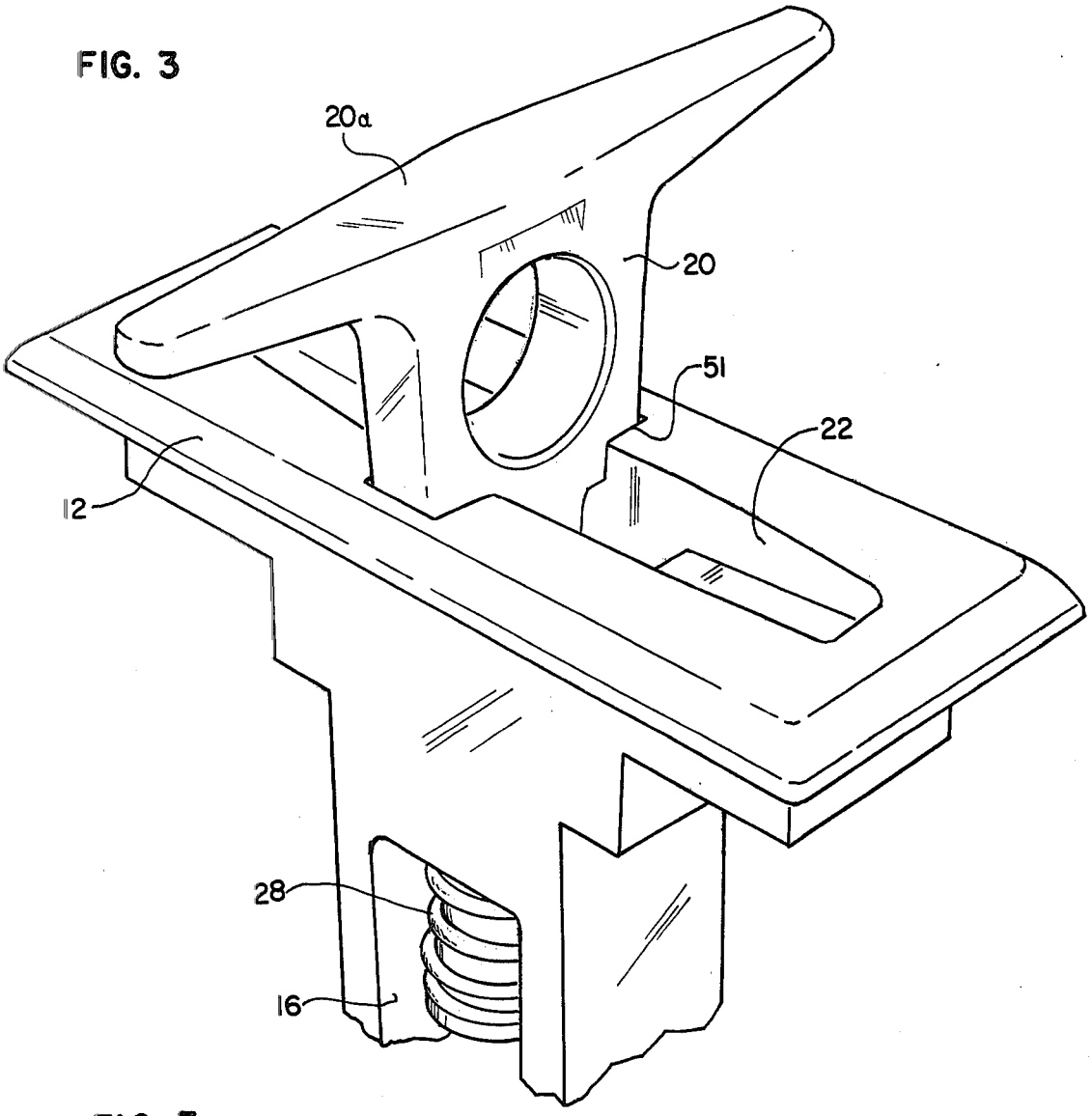
FIG. 3 is a perspective view of our novel lift ring, disposed in a locked position in which it can serve as a cleat.

As shown in dashed lines in FIG. 1, and by full lines in FIG. 2, we utilize a lift ring 20 disposed in the slotted portion 22 of the base plate 12. The uppermost portion 20*a* of the lift ring is flush with the top of the deck plate 12, and the slot 22 is best seen in FIG. 3.

Extending downwardly from the principal portion of the lift ring member 20 is a lower, rod-like portion 26 of circular cross section, which is slidably as well as rotatably disposed in a central portion of the lower structural member 16. As will become more apparent hereinafter, the lower portion 26 serves to prevent the upper portion of the lift ring from undesirably separating from the other components when a lift operation is being carried out. We prefer to construct the lift ring and its integral lower, rod-like portion from a single piece of stainless steel.

As will be noted from FIGS. 1 and 2, we utilize a cavity 27 in the lower structural member 16, such that sufficient access will be afforded for working with the several components utilized on the lower, rod-like member 26.

It will be noted in FIG. 1 that a compression spring 28 extends for a number of turns around the member 26, with the upper end of the spring being received by a circular member 30 that serves not only as the upper spring retainer, but as a thrust washer as well. Member 30 may for example be made of aluminum. The lower spring retainer 32, which in almost all instances will be made of stainless steel, is closely associated with the procedure by which the components that function together during the lifting of a boat are initially assembled. A shoulder 34 on the lower portion of retainer 32 prevents the lower turns of the spring 26 from slipping off.

It will be observed in FIG. 2 that the lower end 36 of the member 26 is of decreased diameter, with the bottom 38 having a slight taper that enlarges in the downward direction. It is upon this taper that the lower spring retainer 32 is supported.

During the assembly of the device, after the lift ring has been inserted into the slotted base plate 12 far enough for the member 26 to enter the cavity 27, the compression spring 28 is placed around the member 26. After this, the member 26 is inserted further, and the spring 28 is compressed sufficiently far that the lower spring retainer 32 can be slid over the tapered portion 38. This lower spring retainer is moved sufficiently far in the spring-compressing direction as to enable a pair of carefully fitted keepers 40 to be inserted around the tapered portion 38. Thereafter, the lower spring retainer 32 is moved back to the position shown in FIG. 1, in which position it anchors the lower end of the spring 28 very securely, for the keepers serve to increase the size of the tapered portion sufficiently as to prevent the ring 32 from coming off unexpectedly. As will afterward be discussed, this locking action is sufficiently strong that the assembled lift ring can easily bear the weight of the boat being lifted.

Typical dimensions of the various portions of member 26 are as follows:

Dimension A—0.875"
Dimension B—0.750"
Dimension C—0.810"

Typical dimensions associated with the lower retainer 32 are as follows:

Dimension D—0.815"
Dimension E—0.875"

The keepers 40, when assembled in their functional positions, have in effect an internal diameter of 0.810" at their bottom end, and an outside diameter of 0.875". As a result of this arrangement, the lower retainer 32 fits tightly over the keepers when they have been placed upon the tapered portion 38, and the retainer can thereafter be moved upwardly to a keeper releasing position only as a result of a deliberate effort.

A 5° taper may be created on the portion 38, and an identical taper created on the lower interior portion of retainer 32. The keepers utilized in each instance are configured to fit properly between the portion 38 and the interior of ring 32. We are not to be limited to a 5° taper, however, and another suitable taper angle for the several members may be chosen if desired.

The spring 28 is selected as to its normal length, wire diameter, and strength on a case by case basis. Inasmuch as it need not play any consequential role in the actual lifting of a boat, the spring need only be of a dimension and strength to assure proper retraction of the lift ring when it has been aligned with its slot.

It will be noted in FIG. 2 that the deck is depicted to be of less thickness than in FIG. 1. In instances of this type, we prefer to use L-shaped brackets 42 held in place by bolts 44 threaded into a thick portion of the base member 12 in order to secure the device in its operative position in the deck.

Although the base plate 12 can be securely affixed to the deck for cleat purposes by the arrangement depicted in either FIG. 1 or FIG. 2, we realize it is necessary to firmly anchor our device to the keel of the boat in order that on occasion it can serve as a lift ring. To that end, we dispose a flange nut 46 in a suitable aperture in the central part of the bottom of the lower structural member 16, which nut is internally threaded to receive the upper end of a threaded rod 47 connected securely to the keel. A shoulder or flange 48 on the flange nut prevents it from being pulled through the aperture in which it is mounted, and wrenching flats are provided on the lower portion of nut 46 in order that the connection to the keel can be made suitably tight by the use of an ordinary wrench.

In FIGS. 2 and 3 it will be noted that we prefer for the lift ring 20 to be of a T-shaped configuration, for in this way it can also serve on occasion as a cleat. Obviously, however, another lift ring configuration can be used if desired.

Figure 3A:
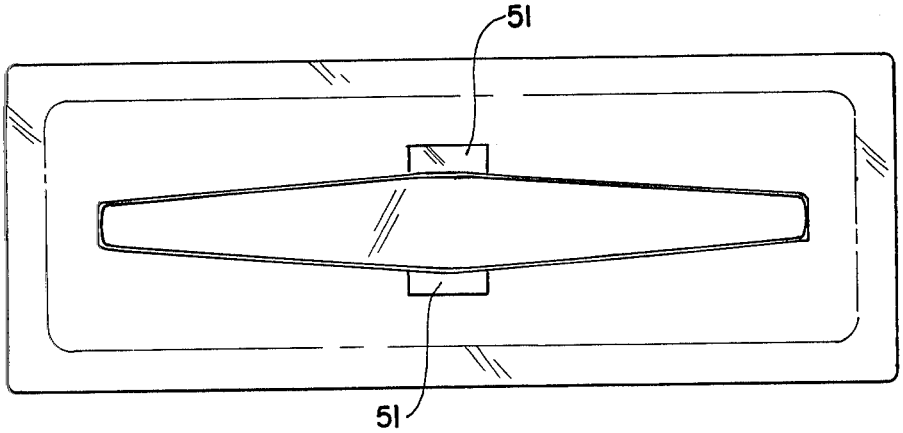
FIG. 3*a* is a top view showing notches in the desk plate that enable the user to easily grasp the lift ring when it is in the retracted position, and in which notches the lift ring may reside when deployed in the active position shown in FIG. 3.
Figure 4:
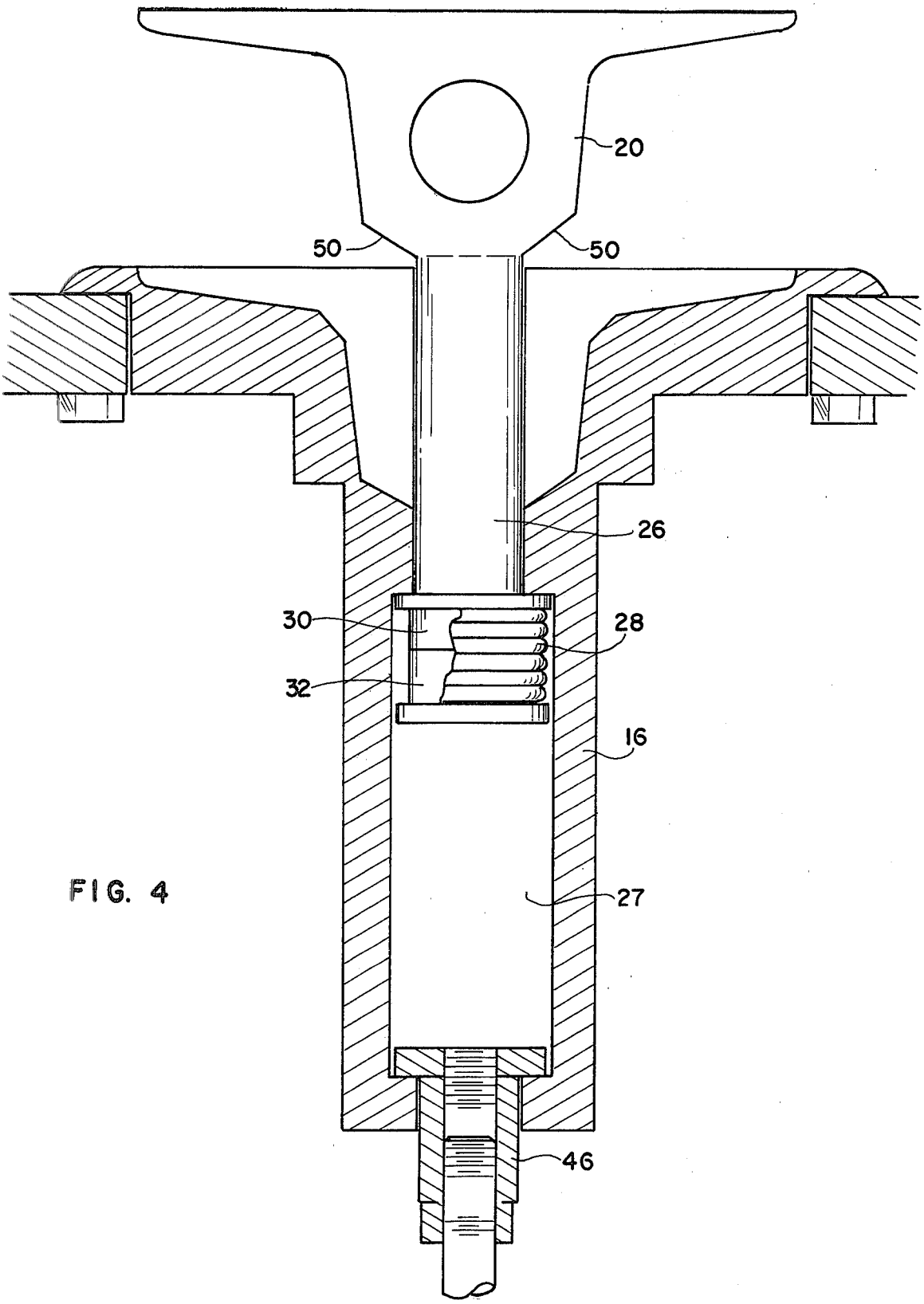
FIG. 4 is a view of our lift ring disposed in the lifting mode.

In order that the component 20 can serve as a cleat, we provide angularly disposed lower edges 50 on the member 20 adjacent the portion 26, which angled edges are designed to be received in suitable notches 51 provided orthogonally to the slot 22, as best seen in FIGS. 3 and 3*a*. As should be obvious, the notches 51 permit a person to easily insert his or her fingers in order to grasp the upper portion of the retracted lift ring 20, pull it upwardly against the bias of spring 28 to the position shown in FIG. 4, and then rotate the lift ring 90° to the position shown in FIG. 3, at which time the lift ring is released so that the base of the lift ring will then rest in the notches 51.

When the lift ring is in the position shown in FIG. 3, it will admirably serve as a cleat, in that it can successfully resist a lateral pull from any direction. However, an upward pull will easily overcome the bias of the compression spring 28, so it is obvious that at any time our device is serving in a lift ring mode, the configuration will be approximately that shown in FIG. 4, that is, with the spring 28 compressed, and the lower retainer 32 in firm compressive contact with the thrust washer 30, as revealed in this Figure.

Figure 5A:
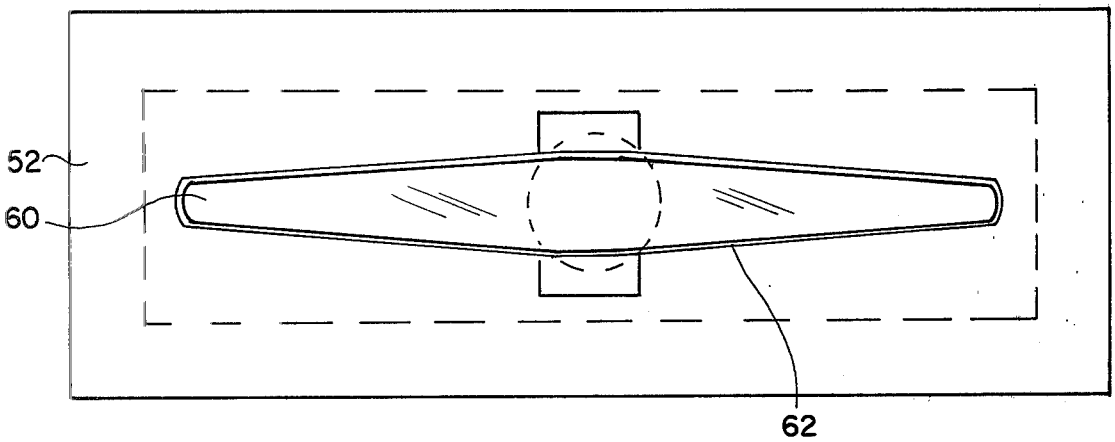
FIG. 5*a* is a view revealing the appearance of this version of our invention as seen from above.
Figure 5:
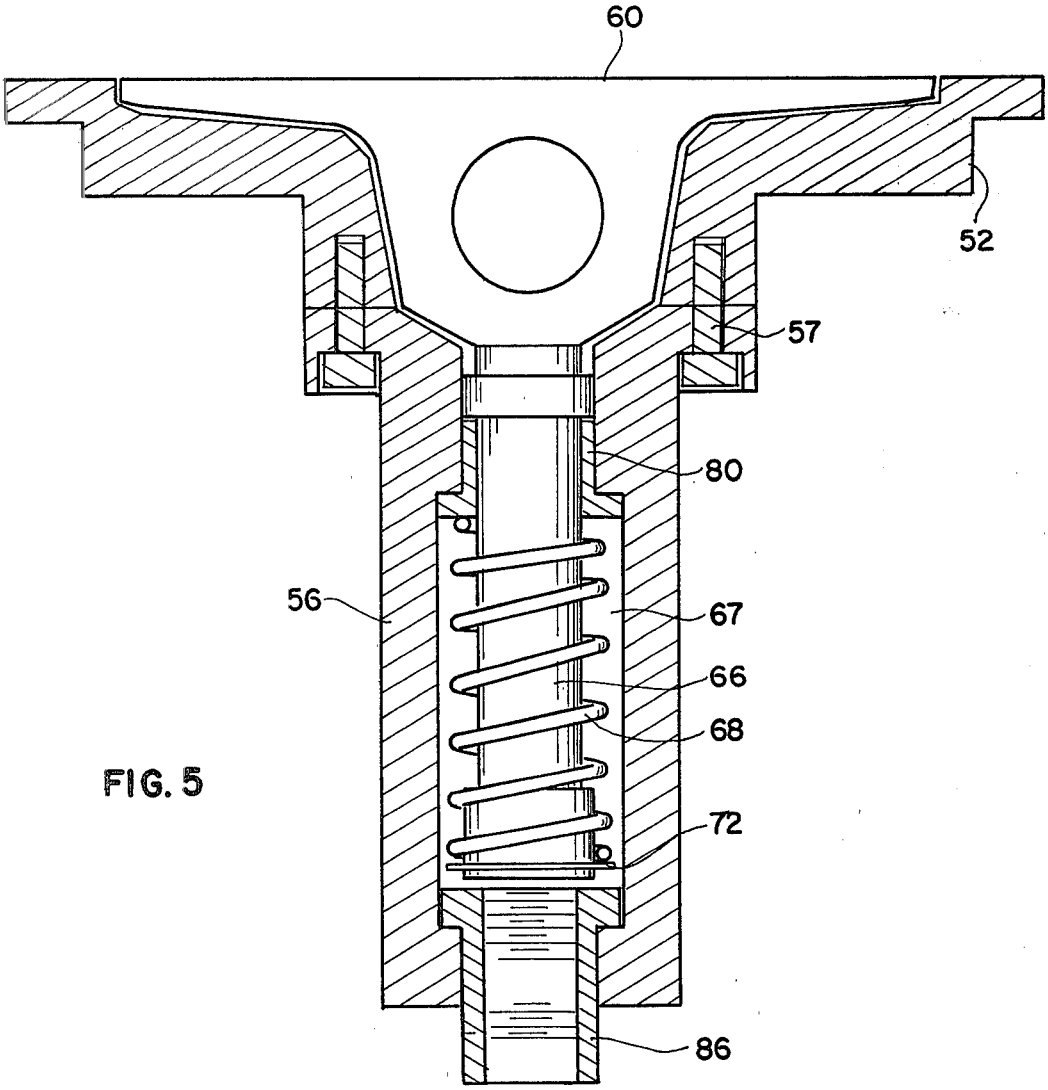
FIG. 5 is a view of a second embodiment of our invention, in which a different spring retaining arrangement is utilized on the lowermost portion of the lift ring mechanism.

Turning now to FIG. 5, it will be seen that we have here depicted an embodiment in which the slotted deck plate member 52, like the deck plate in the previous embodiment, is designed to be installed in a suitable rectangularly shaped slot cut in the deck of a boat. In the present embodiment, however, the elongate structural member 56 disposed below the deck plate 52 is a separately constructed component. The components 52 and 56 are preferably held together in a proper relationship by machine screws 57; note FIG. 5.

Although the base plate 52 may be secured to the deck by screws applied either from above or from below, we prefer that the deck plate mounting screws be applied from below.

Mounted in a slot or cavity 62 in the base member 52 is a lift ring member 60, as shown in FIG. 5*a*, and attached to member 60 is a lower, rod-like portion 66. The portion 66 is integral with the lift ring, and is circular in cross section. The lift ring is thus approximately T-shaped, but could have a different configuration if desired.

As will be noted from FIG. 5, the rod-like portion 66 of the lift ring is principally disposed in a cavity 67 located in the lower structural member 56, and surrounding the lower portion 66 is a compression spring 68. A snap ring 72 secured in a suitable slot disposed around the bottom of rod-like member 66 is utilized to support the bottom of the compression spring 68 in the desired relation to member 66. FIG. 5 also reveals the upper part of the lift ring to be flush with the base plate when in its retracted position.

A threaded flange nut 86 provided with wrenching flats is operatively disposed in the lowermost portion of the member 56, which nut is associated with a rod 87 connecting to the keel of the vessel. The upper flange 88 of the nut 86 prevents it from pulling out of the member 56.

Figure 6:
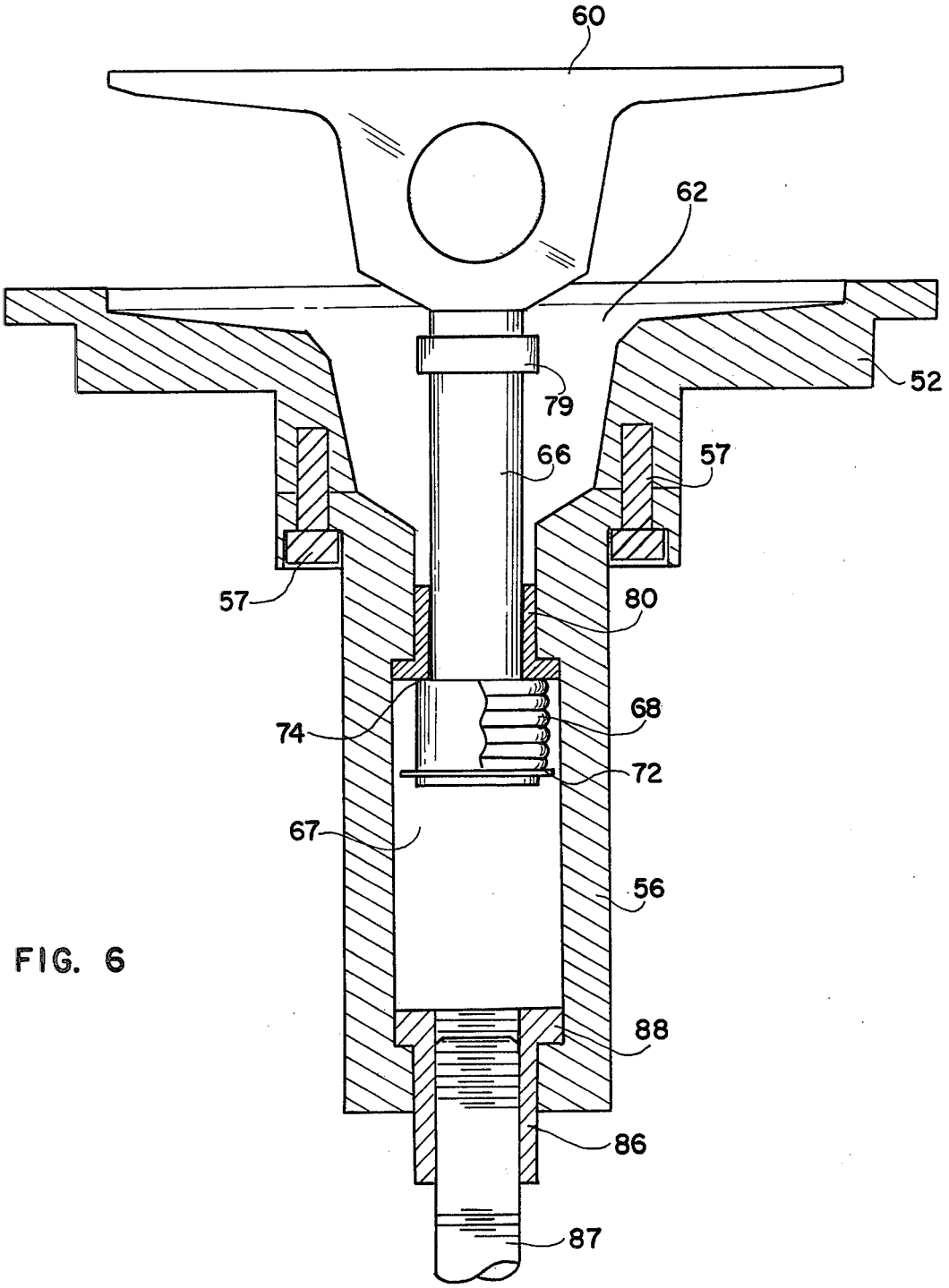
FIG. 6 is a view of the second embodiment of our lift ring when extended into the lifting mode.

It will be realized that when it is desired to lift the boat out of the water, the lift ring 60 is grasped by the fingers, and pulled upwardly out of its cavity or slot to the position shown in FIG. 6, which is against the bias of the spring 68. Thereafter, the member 60 is turned 90 degrees, so that it will reside on the deck plate 52 in the relationship shown in FIG. 7. We provide suitable notches on each side of the slot 62, in which notches the lift ring resides while in the orthogonal position. These slots also provide finger access. As is obvious, if the lift ring is not turned away from alignment with its slot, it will immediately return under the bias of spring 68 to the recessed position, unless of course a rope or line is attached to the lift ring.

Figure 7:
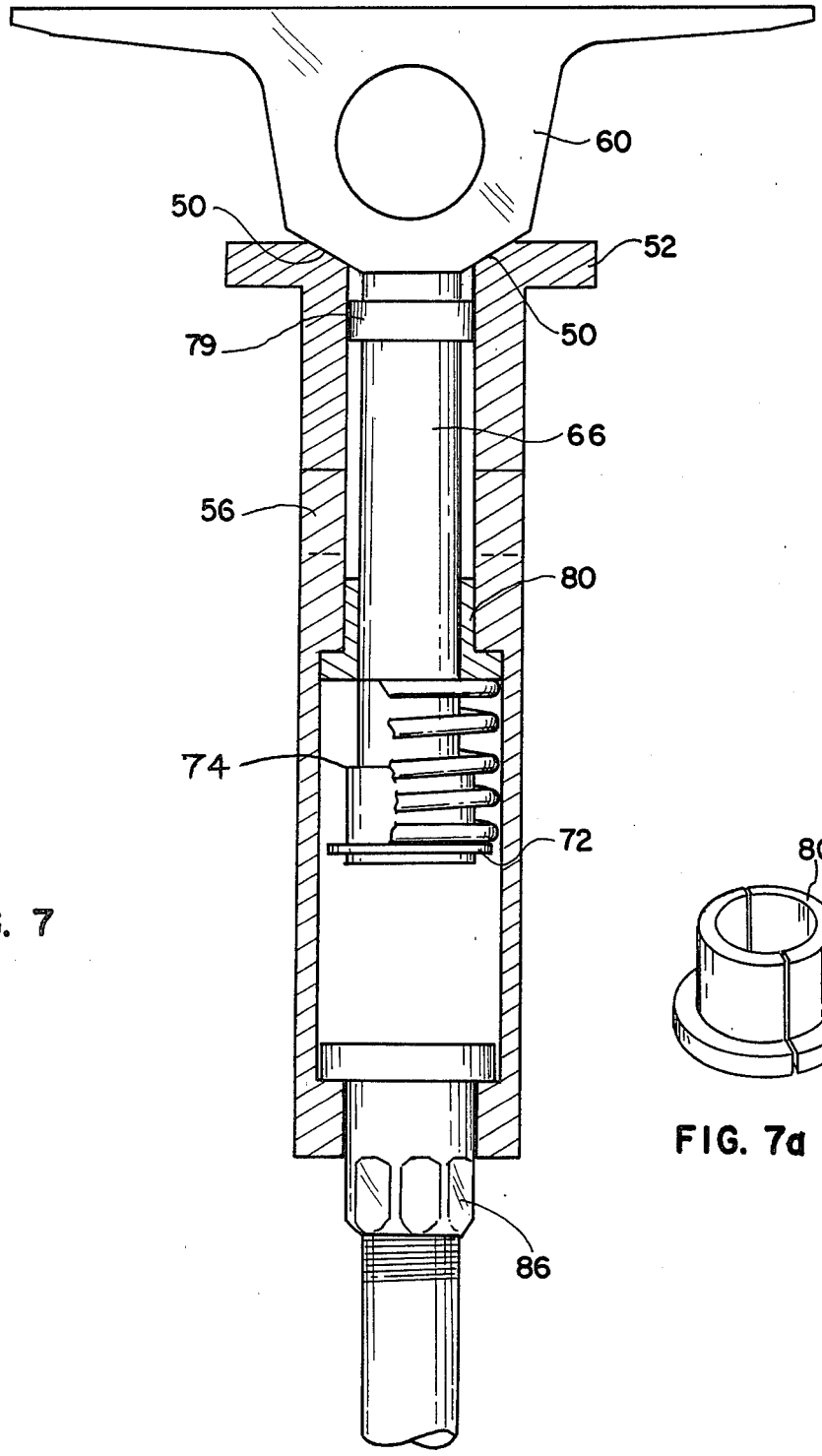
FIGS. 7 and 7*a* are views of the housing taken 90 degrees away from the position shown in many of the early figures, revealing in this instance the lift ring residing in the notches orthogonal to the slot into which the lift ring can retract.
Figure 7A:
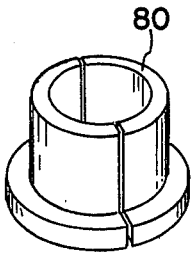

It is important to note that FIG. 6 not only represents a transitory position of the lift ring when it is being moved to the position of FIG. 7, but FIG. 6 also represents the position in which the ring resides when the weight of the boat is being borne.

As previously mentioned, a snap ring 72 is utilized on the bottom portion of rod-like member 66 for spring retention purposes, but it is important to note that when in the lifting mode, the snap ring 72 is not bearing the weight of the boat or other item being lifted. Rather, we provide a shoulder 74 on the bottom of the portion 66, that is used to contact a thrust assembly used in the upper portion of the lower member 56 in order that a sturdy lift arrangement will be created.

We prefer to use a split ring arrangement 80 around the member 66, which split ring fits in the upper end of the cavity 67, and resides against the uppermost interior portion of the member 56. The base portion of the split ring is enlarged in order to receive the shoulder 74, which makes forceful contact with the split ring during the lifting process; note FIG. 6. The split ring members may be of stainless steel, or any other material that is strong, non-corrosive, and unlikely to cause a seizing action between the components. We may provide a plastic coating over the members constituting the split ring assembly.

Assembly of this preferred embodiment is made possible by the use of the split ring 80, for the shoulder 74 will pass through the upper aperture of member 56 when the split ring is not in place. However, if desired for some reason to avoid the split ring, we may use a lower housing 56 made up of vertical halves held together by horizontally disposed bolting means, for this would allow the insertion of a thrust washer of unitary construction, that has for example been welded to the rod-like member 66.

When the lift ring 60 is in the position orthogonal to its slot, as depicted in FIG. 7, it will readily serve as a cleat. We may use a ring 79 disposed around the upper end of member 66, in order that lateral forces will be properly reacted.

It is also to be noted at this point that inasmuch as our lift ring housing is set into the deck of a boat, it can react lateral thrusts much more easily than could prior art lift rings, which usually relied upon four or so ordinary screws to resist lateral forces.

Figure 8:
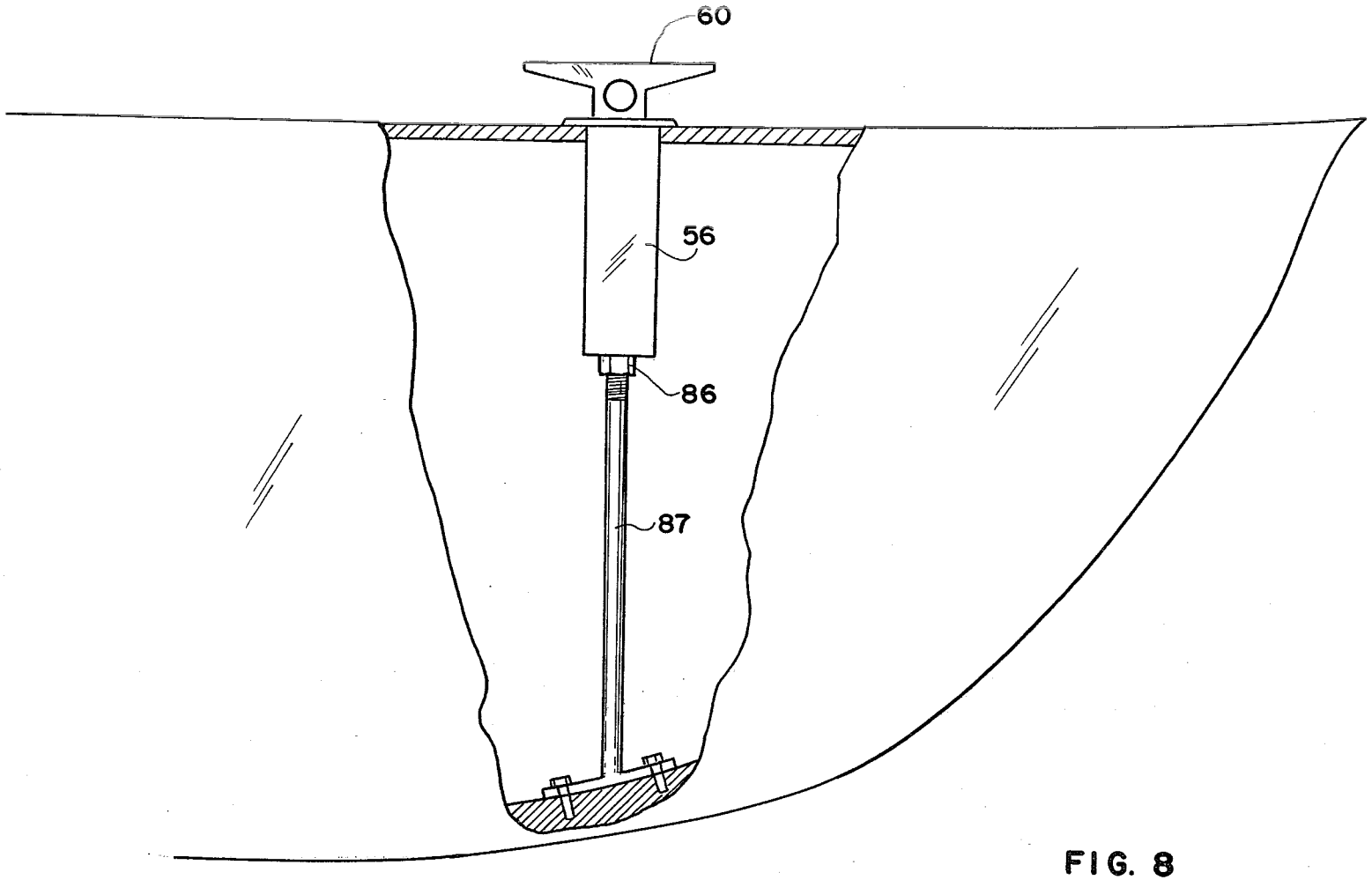
FIG. 8 is a view to a substantially smaller scale in order to reveal the manner in which our novel lift ring device may be secured to the deck and keel of a boat.

Turning to FIG. 8, it will there be noted that we have shown our device connected by rod 87 to the keel of a boat. Visible in this figure is the flange nut 86 which is internally threaded to receive the conventionally threaded upper end of the rod 87. A suitably tight connection with the keel may be provided by utilizing a wrench on the wrenching flats of the nut 86, thus entirely obviating the use of a turnbuckle.

We claim:

1. A retractable lift ring device for installation in the deck of a boat or the like that may from time to time need to be lifted, said lift ring device comprising a slotted deck plate adapted to be affixed in surrounding relation around an aperture in the deck, an elongate structural member secured to the underside of said deck plate at a mid portion thereof, and arranged to extend into the aperture, said elongate structural member having a major dimension approximating the major dimension of said slotted deck plate, with said deck plate and said elongate structural member together forming a component substantially of a T-shaped configuration, a lift ring operatively mounted in the slot in said deck plate, with its upper portion normally being substantially flush with the upper surface of said deck plate, said lift ring having a lower, rod-like portion extending downwardly into said elongate structural member and being slidable therein, said lift ring being able to be manually lifted to a position extending above said deck plate, at which time said rod-like portion has moved upwardly to some extent in said elongate structural member, and spring bias means operatively associated with said rod-like portion and said elongate structural member, the spring bias force being caused to increase as said lift ring is lifted out of said slotted deck plate, said spring bias means serving to bring about prompt return of said lift ring to its recessed position when the lifting force has been removed.

2. The retractable lift ring device as defined in claim 1 in which said lift ring may be rotated out of alignment with the slot in said deck plate, so that unwanted retraction may be prevented.

3. The retractable lift ring device as defined in claim 2 in which notches orthogonal to said slot are provided, into which the base of said lift ring can be received when said lift ring has been turned 90° to the slot, said lift ring being able to serve effectively as a cleat when residing in said notches.

4. The retractable lift ring device as defined in claim 1 in which a threaded nut, captive in the bottom of said elongate structural member, can be tightened when engaging a threaded rod attached to the keel of the boat, thus enabling the lift ring device to be firmly secured to the boat without the use of a turnbuckle.

5. The retractable lift ring device as defined in claim 1 in which a circular, tapered wedge arrangement is utilized at the lower end of said rod-like portion, to serve as a retainer for the lower end of said spring bias means, said tapered wedge arrangement also being capable of bearing a substantial amount of weight.

6. The retractable lift ring device as defined in claim 1 in which a snap ring is utilized at the lower end of said rod-like portion, to serve as a retainer for the lower end of said spring bias means.

7. A retractable lift ring device for installation in the deck of a boat or the like comprising a slotted deck plate adapted to be affixed in surrounding relation around an aperture in the deck, an elongate structural member secured to the underside of said deck plate at a mid portion thereof, and arranged to extend for a substantial distance into the aperture, said elongate structural member having a major dimension approximating the major dimension of said slotted deck plate, with said deck plate and said elongate structural member together forming a component substantially of a T-shaped configuration, a lift ring operatively mounted in the slot in said deck plate, said lift ring having a lower, rod-like portion extending downwardly into said elongate structural member and being slidable, said lift ring normally residing in a position in which its upper portion is substantially flush with the upper surface of said deck plate, said lift ring being able to be manually lifted to a position extending above said deck plate, at which time said rod-like portion has moved upwardly to some extent in said elongate structural member, spring bias means operatively associated with said rod-like portion and said elongate structural member, the spring bias force being caused to increase as said lift ring is lifted out of said slotted deck plate, said spring bias means serving to bring about prompt return of said lift ring to its recessed position when the lifting force has been removed, and a threaded nut, captive in a location near the bottom of said elongate structural member, said nut being rotatable and able to engage the upper end of a threaded rod attached to the keel of the boat, thus enabling, when said nut has been tightened, said slotted deck plate to be firmly secured to the keel without the use of a turnbuckle.

8. The retractable lift ring device as defined in claim 7 in which a circular, tapered wedge arrangement is utilized on the lower end of said rod-like portion, to serve as a retainer for the lower end of said spring, and to bear a substantial amount of weight during a lifting procedure.

9. The retractable lift ring device as defined in claim 7 in which a snap ring is utilized on a lower part of said rod-like portion, to serve as a retainer for the lower end of said spring.

10. The retractable lift ring device as defined in claim 7 in which said lift ring and its lower, rod-like portion are rotatable in said T-shaped component, such that said lift ring, when raised against said spring bias means to a location above said slotted deck plate, can be turned approximately 90° to prevent unwanted retraction.

11. The retractable lift ring device as defined in claim 10 wherein notches orthogonal to said slot are provided, into which the base of the lift ring can be placed when in its raised position, thus enabling the lift ring to serve as a cleat.

* * * * *